United States Patent [19]

Soto

[11] 4,006,823

[45] Feb. 8, 1977

[54] STERILE BAG PAD

[76] Inventor: Ricardo Hurtado Soto, Apartado 91711, Bogota, Colombia

[22] Filed: Feb. 25, 1976

[21] Appl. No.: 661,405

[52] U.S. Cl. ..... 206/554; 128/DIG. 24; 229/53

[51] Int. Cl.[2] ..... B65D 31/00; B65D 85/54

[58] Field of Search ..... 128/DIG. 24; 206/466, 206/472, 484, 526, 801; 225/27; 229/53; 281/16

[56] References Cited

UNITED STATES PATENTS

| | | | |
|---|---|---|---|
| 1,254,966 | 1/1918 | Bens | 229/53 |
| 1,534,124 | 4/1925 | Kemp | 225/27 |
| 3,021,947 | 2/1962 | Sylvester et al. | 206/526 |
| 3,346,104 | 10/1967 | Marsh | 206/526 X |

FOREIGN PATENTS OR APPLICATIONS

| | | | |
|---|---|---|---|
| 2,335,224 | 1/1975 | Germany | 206/466 |

*Primary Examiner*—Steven E. Lipman
*Attorney, Agent, or Firm*—Tilton, Fallon, Lungmus, Chestnut & Hill

[57] ABSTRACT

A pad of sterile bags wherein each bag is made of flexible thermoplastic sheets. The bags are heat-fused together along the open edge to provide a book-like pad. The weld forms a binding for the individual bags, which are without perforation, and it also forms a solid margin for gripping and handling and provides a line of weakness along which the bags may be separated for use. When a bag is thus separated from the pad it is also opened.

4 Claims, 2 Drawing Figures

Fig. 1
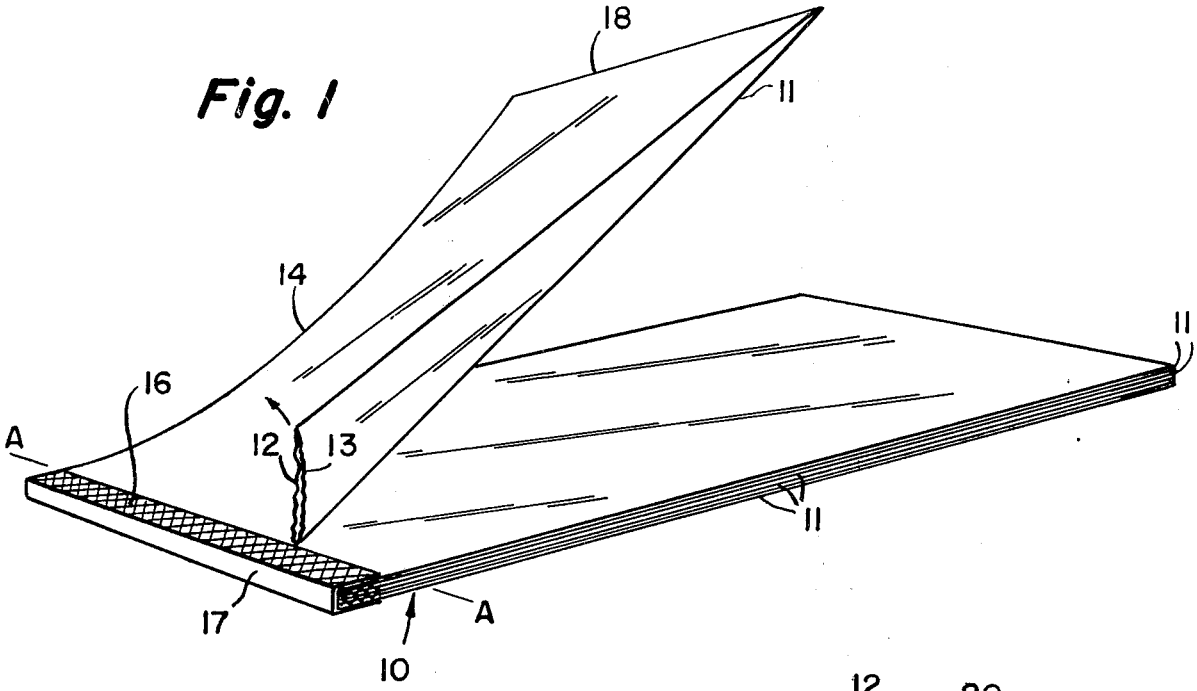
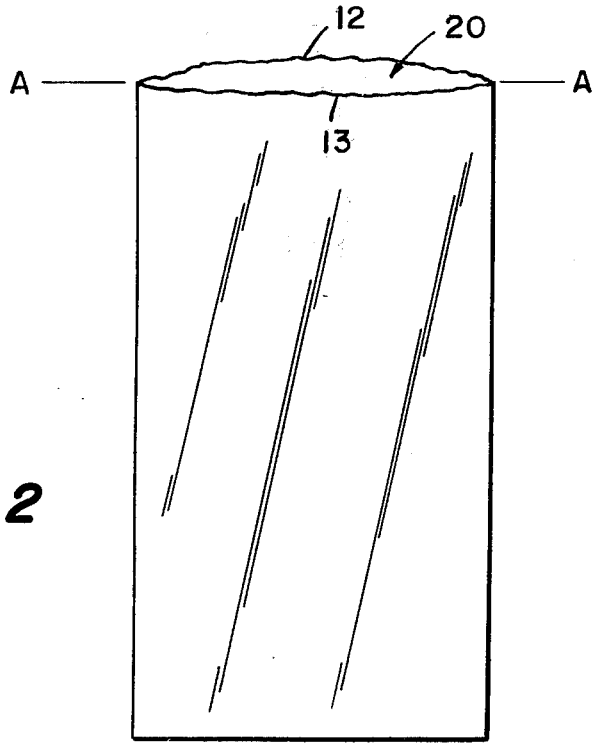
Fig. 2

STERILE BAG PAD

BACKGROUND AND SUMMARY

The present invention relates to a pad of thin, flexible bags which are manufactured and sold in a sterile condition. Such bags may be used in a hospital or surgery room, and it is desired that sterility be maintained until the time of use.

The idea of providing flexible bags in packet form is not new; see, for example, U.S. Pat. No. 3,312,339. However, in that patent, bags are held together by a separate fastener which functions like a desk calendar holder and also provides a shearing edge along which individual bags are torn for removal from the pad. Lines of perforation extend across the top of the bags and they are in alignment with apertures for receiving the fastener to facilitate removal of an individual bag.

Other patents relating to the provision of a plurality of separate bags include U.S. Pat. Nos. 3,353,661, 3,021,947, 3,768,725, and 3,627,611, and 3,341,003.

All of the articles disclosed in the above patents suffer from one or more of the following disadvantages or defects: inability to maintain sterility, too great a cost in relation to end use, difficulty of handling or replacing bags, difficulty of removing bags, or requirement of additional manufacturing operation, such as perforating or punching of holes.

In the present invention, a pad of sterile bags is provided wherein each bag is made of a thin, flexible thermoplastic material, such as sheet polyethylene having a thickness of approximately one mil. The bags are provided in side-by-side relation, and each bag includes a continuous sealed edge. The mouths of the bags are heat-fused to provide a book-like pad with the opposite edges of the bags being free from one another.

The weld or fusion area forms a binding for the individual bags which are without perforation or other aperture. The binding provides a solid marginal grip to facilitate handling of the pad, and it also defines a line of weakness for each individual bag. A bag may be removed from the pad by holding the stiffened margin and separating along the fused edge. When a bag is thus separated from the pad, it is automatically opened for use.

Thus, with the present invention, a plurality of bags are provided in an integral pad and in such condition as to maintain sterility until use. When a bag is removed from the pad, the mouth is automatically opened for use. The pad is thus economical to manufacture, convenient to use, has long storage life without diminished sterility, and does not require extraneous manufacturing operations such as perforating or hole-punching.

Other features and advantages of the present invention will be apparent to persons skilled in the art from the following detailed description of a preferred embodiment accompanied by the attached drawing.

THE DRAWING

FIG. 1 is a perspective view of a pad of bags incorporating the present invention, illustrating the step of removing one of the bags from the pad; and FIG. 2 is an upper perspective view of one of the bags after it has been removed.

DETAILED DESCRIPTION

Referring then to the drawing, reference numeral 10 generally designates a pad of sterile bags. Individual bags in the pad 10 are designated by reference numeral 11. Each of the bags 11 includes two sides, 12, 13 which are joined by a continuous, sealed edge 14.

The bags 11 are formed of thermoplastic sheet material, such as polyethylene, having a preferred thickness of approximately one mil., although the invention may be practiced with thicknesses in the range 0.5 mils – 1.25 mils.

In the pad, all of the bags 11 are aligned in side-by-side relation; and they are heat-welded or fused together along one edge, designated 16. Enough of the bag material is fused to provide a thick marginal binding 17 along a common edge for all of the bags. The opposite end of each bag, designated 18, is free so that, in the pad, the bags are arranged in book-like fashion.

The dimensions of the marginal binding 17 are not critical, and will be determined by the functions which it performs--namely, to provide a stiffened element for maintaining the bags generally flat in side-by-side relation in the pad, providing a grip for handling the pad, and providing a grip for holding the pad while an individual bag is removed.

An individual bag is removed from the remainder of the pad by tearing along the marginal binding 17, as illustrated in partial removal in FIG. 1. That is to say, with one hand holding the marginal binding 17, the other hand takes the free end 18 of the bag (preferably the top bag) and tears along the marginal binding.

When a bag is removed from the pad, as seen in FIG. 2, the two sides 12, 13 are separated to provide an open mouth 20 into which an item may readily be placed immediately upon removal with the realization that the interior of the bag is sterile even though the bag may have been stored perhaps unintentionally, under conditions that could promote contamination.

It will thus be appreciated that the present invention provides a plurality of individual bags in a pad with the bags located side-by-side and joined together along one marginal edge by fusing the material of the bags along that edge into a solid binding. The binding acts to facilitate handling of the pad and separation of the individual bags from the pad. The bags are manufactured in a sterile condition and that condition is maintained for an indefinite storage period until the bags are separated from the pad, at which time, they are torn along the marginal binding which provides a line of weakness but not a breach of the sterile interior. When thus separated, the mouth of each bag is opened for use.

It will also be possible to place sterile articles such as adhesive bands, suture thread within the bags so that the bags act as containers for sterile packages which may be individually dispensed without affecting the sterility of remaining packages.

Having thus described in detail a preferred embodiment of the invention, persons skilled in the art will be able to modify certain of the structure which has been illustrated and to substitute equivalent materials for those disclosed while continuing to practice the principle of the invention; and it is, therefore, intended that all such modifications and substitutions be covered as they are embraced within the spirit and scope of the appended claims.

I claim:

1. An article comprising a plurality of closed, sterile bags of thin, flexible thermoplastic sheet material aligned and arranged in side-by-side relation and bound together along a common marginal edge with a heat-fused thick, stiffened binding whereby all of said bags form a book-like pad, the ends of said bags opposite said binding being free and the edges of said bags adjacent said binding being weakened but continuous adjacent said binding, whereby a bag may be removed from said pad by holding said binding in one hand, grasping the free end in the other hand and tearing along the line of weakness to separate the bag from the binding in an opened condition.

2. The article of claim 1 wherein each of said bags has a generally rectangular shape and is characterized in being free of breaches or perforations to maintain sterility within the bag for an indefinite period of time.

3. The article of claim 1 wherein each bag is made of polyethylene sheet material having a thickness in the range of 0.5 – 1.25 mils.

4. An article comprising a plurality of sterile bags of thin, flexible thermoplastic sheet material aligned and arranged in side-by-side relation, all of said bags having three closed sides and an openable side providing a mouth; a thick, stiffened binding member; all of said bags being fused to said binding member adjacent their mouths, the sides of said bags opposite said binding member being free and the mouths of said bags adjacent said binding member being closed and continuous but weakened adjacent said binding, whereby an individual bag may be removed by holding said binding member in one hand, grasping the free end in the other hand, and tearing along the line of weakness to separate the bag from the binding members while opening said removal bag.

* * * * *